United States Patent [19]

Senoh

[11] Patent Number: 4,525,607

[45] Date of Patent: Jun. 25, 1985

[54] SIMPLIFIED ELECTRIC SWITCH CONSTRUCTION

[76] Inventor: Yasutaka Senoh, 1783 Nippa-cho, Kohhoku-ku, Yokohama-shi, Kanagawa-ken, Japan

[21] Appl. No.: 567,700

[22] Filed: Jan. 3, 1984

[30] Foreign Application Priority Data

Feb. 4, 1983 [JP] Japan ..... 58-17947
Feb. 4, 1983 [JP] Japan ..... 58-17948

[51] Int. Cl.[3] ..... H01H 15/02

[52] U.S. Cl. ..... 200/16 R; 200/6 R; 200/6 B; 200/153 LA

[58] Field of Search ..... 200/1 B, 1 V, 6 R, 6 B, 200/6 BA, 6 BB, 6 C, 16 R, 16 D, 11 R, 11 G, 153 LA, 68.1, 68.2, 68.3

[56] References Cited

U.S. PATENT DOCUMENTS

| | | | |
|---|---|---|---|
| 3,770,921 | 11/1973 | Wilbrecht | 200/16 R X |
| 4,095,072 | 6/1978 | Piber | 200/1 V X |
| 4,168,404 | 9/1979 | Lockard | 200/16 D X |
| 4,319,100 | 3/1982 | Tallody | 200/16 R |
| 4,392,031 | 7/1983 | Curtis, III | 200/6 R X |

*Primary Examiner*—J. R. Scott
*Attorney, Agent, or Firm*—Pahl, Lorusso & Loud

[57] ABSTRACT

A simplified electric switch is disclosed which includes: an insulating base (3) which may include an electronic circuit and printed circuit board, a switch cover (4) mounted on the base; terminals (1*a*, 1*b*, 2*a*, 2*b*) disposed on the base, internal lead wires (16*a*, 16*b*, 17*a*, 17*b*) opposed to each other and connected to the terminals, a rocking type movable contact element (6) in the form of an electrically conductive plate and a push member (7) which may be a slide member, toggle member, or rotary member. The movable contact element has a gently curved belly portion (15), reversely bent shoulder portions (14) on opposite sides of the belly portion, and polygonal pyramidal shaped contact ends (8*a*, 8*b*, 9*a*, 9*b*). The belly portion is centrally provided with a projection (12). The movable contact element is mounted on the insulating base and rocks about the projection. The push member has a protrusion (13) that engages the projection from inside and an arm (13*a*) interposed between a shoulder portion and the lower surface of the switch cover. The push member can be biased towards its neutral position. When the push member is moved to either one side of the internal lead wires, the protrusion of of this push member pushes the belly portion for bringing the contact ends into engagement with their respective internal lead wires, thereby exciting the terminals on that side.

3 Claims, 18 Drawing Figures

SIMPLIFIED ELECTRIC SWITCH CONSTRUCTION

BACKGROUND OF THE INVENTION

The present invention relates to a simplified electric switch construction which has two juxtaposed rows of terminals, the terminals of each row being adapted to be electrically connected together or connected to a common terminal and excited, which can effect stable switching and which can be very miniaturized. The present invention also relates to a switch which is simple in structure and capable of effecting stable switching operation stably, which can be miniaturized, and which incorporates an electronic circuit.

In many kinds of conventional discrete-component switches such as sliding switches and toggle switches, opposed and spaced contact elements are directly connected together by a push member or indirectly connected together via a moving contact element to provide electrical coupling therebetween. Generally, in a dual-in line package, abbreviated DIP, making use of such a switch terminals from each of the juxtaposed rows are electrically connected rather than adjacent terminals. This conventional package is difficult to miniaturize. Further, miniaturization of a dual-in line package in which adjacent terminals are electrically connected together is also limited, if it has the same construction as the conventional discrete-component switches. In addition, the contact condition of the contact elements may introduce problems.

Another type of dual-in line package has also been heretofore known in which switch driving portions are selectively actuated for providing a desired electrical connection between desired terminals via an electronic circuit incorporated in the package. This DIP switch has terminals which are similar to those of ordinary DIP switches and are connected to some portions of an electronic circuit fabricated on a printed board or the like, the switch being enclosed in a casing. Such switches tend to be bulky, because they combine a DIP switch and a separate printed board, which has an electronic circuit fabricated thereon and is usually encased in a molded resin material. Accordingly, a construction wherein a DIP switch is made integral with a printed board is desirable. However, the construction of the conventional discrete-component switch for use in a DIP switch does not allow a considerable miniaturization. Further, since the switch handles minute electric current, the stability of the contact state at its contact portions is not ensured. For example, even if contact portions printed on a printed board are pressed by the contact element of a switch having a conventional construction, a good contact will not be made. Therefore, it is required that the contact portions of the printed board and of the contact element be plated with gold and that the contact area of the contact portions be large.

SUMMARY OF THE INVENTION

The above-described drawbacks in the prior art devices have been successfully eliminated by the present invention.

It is an object of the present invention to provide an electric switch construction which has two juxtaposed rows of terminals wherein the terminals within one row may be electrically connected together or connected to a common terminal and excited, and which is simple in structure and which provides a stable switching operation.

It is another object of the invention to provide an electric switch construction which is simple in structure and capable of effecting its switching operation stably, can be quite miniaturized, and which incorporates an electronic circuit.

These objects are achieved in accordance with the teachings of the present invention by providing a simplified electric switch structure which comprises: an insulating base; a switch cover mounted on the base; internal lead wires to which terminals are bonded in opposed relation to each other, the wires being mounted on the base; a rocking type movable contact element consisting of an electrically conductive plate and having a gently curved belly portion, reversely bent shoulder portions at opposite ends of the belly portion, and contact ends each shaped into a pyramid at both ends of the contact element, the belly portion being centrally provided with a projection, the contact element being mounted so as to be able to rock about the projection; and a push member having a protrusion that comes into abutting engagement with the side of the projection opposite the base. The push member is provided with an arm held between one of the aforementioned shoulder portions and the lower surface of the switch cover, the push member being adapted to be anchored at its neutral position, the protrusion of the push member acting to contact and move along the belly portion to rock and flex the contact element, thereby bringing the contact ends into contact with the corresponding internal lead wires and exciting the terminals on one side, when the push member is moved to that side of the switch.

In a further aspect of the invention, an electric switch includes an insulating base, terminals equipped with ordinary external lead wires and disposed on opposite sides of the base in a predetermined manner, terminals to which no external lead wires are connected, a printed board, and an electronic circuit formed on the underside of the board. Some of the internal lead wires extend upwardly, while the others extend downwardly, and these wires hold the board therebetween. The upper internal lead wires are opposed to each other on the printed board, while the lower internal lead wires are connected with the associated portions of the electronic circuit.

These and other objects and features of the invention will become apparent from the following description of embodiments thereof when taken together with the accompanying drawings.

DETAILED DESCRIPTION OF PREFERRED EMBODIMENTS

Figure 1:
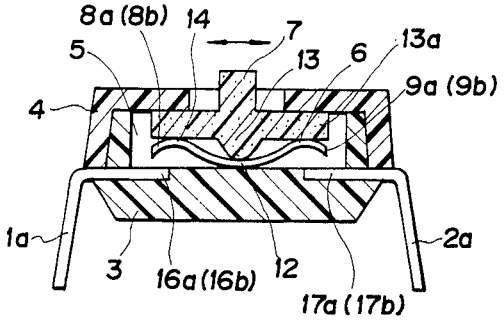
FIG. 1 is a cross-sectional view of a switch according to the present invention.
Figure 3:
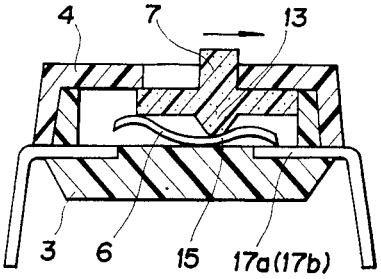
FIG. 3 is a cross-sectional view of the switch shown in FIG. 1 when the push member of the switch has been moved to the right.
Figure 2:
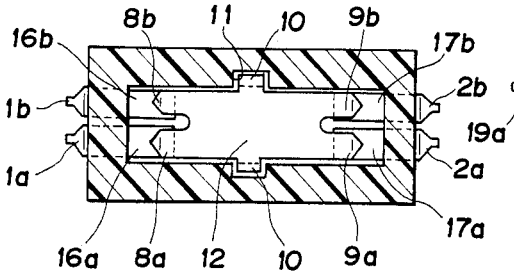
FIG. 2 is a plan view of the switch shown in FIG. 1.
Figure 6:
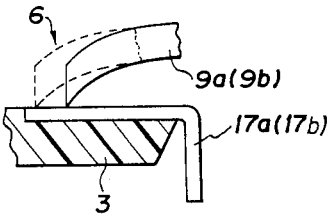
FIG. 6 is a for illustrating the operation of the movable contact element of the switch shown in FIGS. 1–3.
Figure 16A:
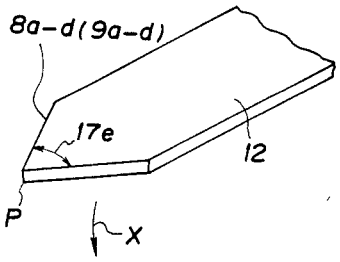
FIGS. 16 (*a*) and 16 (*b*) are perspective views of the movable contact element shown in FIG. 6 illustrating the manufacturing process of same.
Figure 16B:
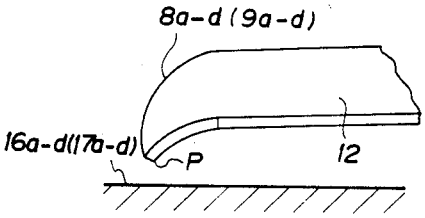

Referring first to FIGS. 1 and 2, there is shown a switch embodying the concept of the present invention. This switch is comprised of an insulating base 3, two parallel rows of terminals 1*a*, 1*b* and 2*a*, 2*b* disposed on opposite sides of the base 3, a switch cover 4 mounted on the base 3, a movable contact element 6, and a push member 7. The contact element 6 and the push member 7 are disposed in the space 5 which is formed between the base 3 and the cover 4. The contact element 6 has a belly portion 15 which is downwardly and gently curved to a central projection 12. The element 6 is mounted on the base 3 such that the element 6 can rock about the projection 12. The contact element 6 further has shoulder portions 14 bent in a direction opposite to the direction in which the belly portion 15 is curved, on opposite ends of the belly portion 15. Formed on opposite sides of the element 6 are two pairs of contact ends 8*a*, 8*b* and 9*a*, 9*b* each of which is blanked by a press into a knife-edged vertex P at an acute angle 17*e* (FIG. 16 (*a*)). Each end in the form of a polygonal pyramid, in this illustrative example a triangular pyramid, is bent in the X direction (FIG. 16 (*b*)). The base 3 is provided with a pair of recesses 11 which receive protruding portions 10 formed on opposite sides are pivoted. These protruding portions 10 are disposed so as to allow element 6 to rock about the downwardly directed projection 12. The arm 13*a* slides between the inner surface of the cover 4 and the shoulder portions 14, and is biased toward its neutral position. When the push member is moved to the right, as shown in FIG. 3, the protrusion 13 presses the belly portion 15, so that the contact ends 9*a* and 9*b* at the front end of the element 6 contact with internal lead wires (bridge portions) 17*a* and 17*b* connected to the terminals 2*a* and 2*b*, respectively, whereby the terminals 2*a* and 2*b* are excited. During this movement, the contact element 6 is resiliently deformed, and contacts 9*a* and 9*b* move in contact with bridges 17*a* and 17*b* from the positions indicated by the solid lines in FIG. 6 to the positions indicated by the broken lines. Therefore, even if flux is present on the internal lead wires or an oxide coating is formed on the wires, it is scraped off by the moving contact and hence good contact is ensured.

Similarly, when the push member 7 is moved to the left, the contact ends 8*a* and 8*b* are brought into contact with the internal lead wires 16*a* and 16*b*, exciting terminals 1*a* and 1*b*.

In the above example, two terminals are provided on each side of the base 3, but the number of terminals is not limited to two. A greater or less number of terminals may be provided. Further, while in the above embodiment, the contact element 6 is moved by the push member 7, it is also possible to use a toggle or rotary means to move the contact element 6. Since the invention provides a simple structure, it can readily be applied to a DIP switch, thus enabling miniaturization of the DIP switch.

Figure 4:
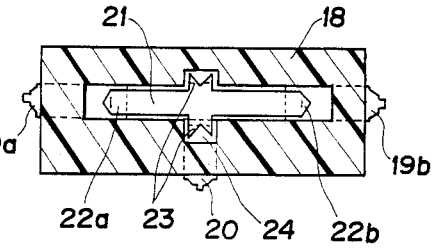
FIG. 4 is a partially cutway plan view of another switch according to the invention.
Figure 5B:
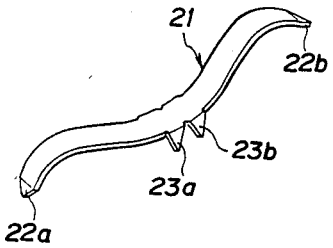
FIG. 5B is a perspective view of the movable contact element used in the switch shown in FIGS. 4 and 5A.
Figure 5A:
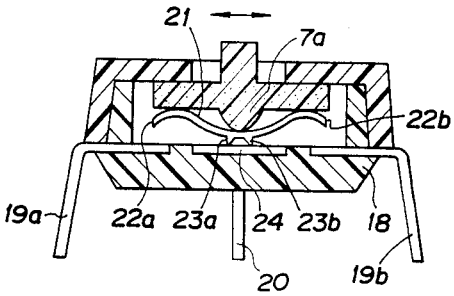
FIG. 5A is a cross-sectional view of the switch shown in FIG. 4.

Referring next to FIG. 4, there is shown another switch which comprises an insulating base 18, one terminal 19*a* disposed on one side of the base, another terminal 19*b* disposed on the other side, and a common terminal 20. One or the other of the terminals 19*a* and 19*b* may be electrically excited by connection to the common terminal. This switch has a contact element 21 similar to the contact element 6 shown in FIG. 1, but the contact element 21 has only one contact point at each end 22*a* and 22*b* and a contact 23 in the center which contacts the common terminal 20 (FIG. 5B). In this embodiment, the tip of the contact end 23 preferably is divided into two knife-edged portions 23*a* and 23*b* to ensure that the contact element 21 makes stable contact with an internal lead wire 24 (FIGS. 4 and 5*a*) connected to the common terminal 20, regardless of whether the contact element 21 is located at its neutral position or a contact position. In this switch, when a push member 7*a* is moved to the left, the terminals 20 and 19*a* are connected together and excited, while when it is moved to the right, the terminals 20 and 19*b* are connected and excited.

As can be seen from the foregoing embodiment, the present invention provides a switch adapted to electrically connect together the terminals on one side or the other of the insulating base or to connect these terminals to a common terminal and excite them. Since the switch is simple in structure and capable of effecting a stable switching operation, it can be formed as a very small DIP (dual-in line package) switch which handles a small electric current.

Figure 7:
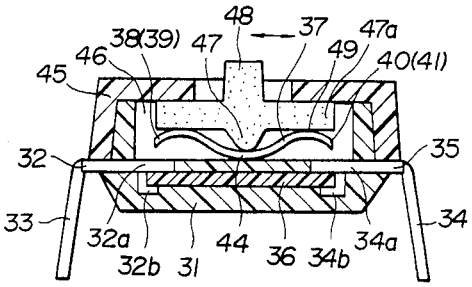
FIG. 7 is a cross-sectional view of another switch according to the invention.
Figure 8:
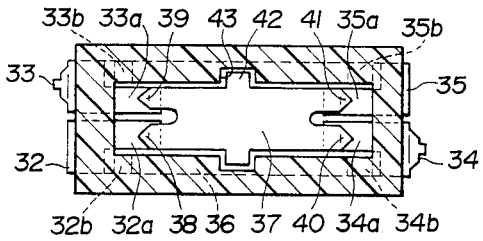
FIG. 8 is a plan view partially in section of the switch shown in FIG. 7.

Referring now to FIGS. 7 and 8, there is shown a DIP switch making use of the aforementioned novel switch construction and incorporating an electronic circuit. This DIP switch has an insulating base 31, terminals 32, 33 disposed on the left side of the base, and terminals 34, 35 disposed on the right side of the base. The terminals 33 and 34 have ordinary external lead wires attached thereto, whereas the terminals 32 and 35 have no external lead wires attached thereto. These terminals are disposed in a predetermined manner. Some of the internal lead wires connected to the terminals 32–35 extend upwardly, while the others extend downwardly. An electronic circuit is formed on the underside of a printed board 36, which is held between the upper internal lead wires 32*a*, 33*a*, 34*a*, 35*a* and the lower internal lead wires 32*b*, 33*b*, 34*b*, 35*b*. The lower lead wires 32*b*–35*b* are connected to the associated portions of the electronic circuit (described later), and all of them are enclosed in the molded insulating base to constitute a unit, thereby enabling a substantial miniaturization of the switch. The upper internal lead wires 32*a*–35*a* are disposed on the upper surface of the printed board, and are arranged opposite contact ends 38, 39, 40 and 41 which bend downwardly. These contact ends 38–41 are shaped into a knife-edged form by cutting both ends of contact element 37.

Figure 9:
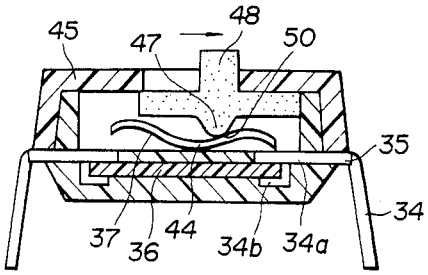
FIG. 9 is a cross-sectional view of the switch of FIG. 7 when the push member of the switch has been moved to the right.

The contact element 37 consists of an electrically conductive plate, the opposite end portions of which are gently bent downwardly, so that the element 37 is shaped like inverted "U". The contact element 37 has opposed protruding portions 42 at its center. The base 31 is provided with recesses 43, in which the protruding portions 42 pivot. A switch cover 45 defines a space 46 in which the contact element 37 is disposed so as to rock about a projection 44 in the center of the element 37. The projection 44 is gently bent downwardly like the letter "U". The protruding portion 47 engages the inner side of the projection 44 from above, and the push member 48 is provided with shoulder portions 49 which are pressed against the cover 45. Thus, the contact element 37 is anchored at its neutral position. When the push member 48 is moved to the right, the protrusion 47 pushes the belly portion 50, as shown in FIG. 9, bringing the contact ends 40 and 41 into contact with the upper internal lead wires (bridge portions) 34*a* and 35*a*. As a result, the terminals 34 and 35 are electrically connected together and excited. On the other hand, the terminals 32 and 33 are not connected together. In this case, as the push member 48 is shifted, the contact element 37 is resiliently deformed so that the vertices P of the knife-edged contact ends 40 and 41 contact and rub the internal lead wires 34*a* and 35*a*. Therefore, even if flux is present on these internal leads or on oxide coating is formed on them, such unwanted material is scraped off, thereby exposing the active surfaces. Consequently, good contact is made. Likewise, when the push member 48 is moved to the left, the contact ends 38 and 39 come into contact with the upper internal lead wires 32*a* and 33*a*, so that the terminals 32 and 33 are electrically connected together and excited. At the same time, the terminals 34 and 35 are disconnected.

Figure 10:
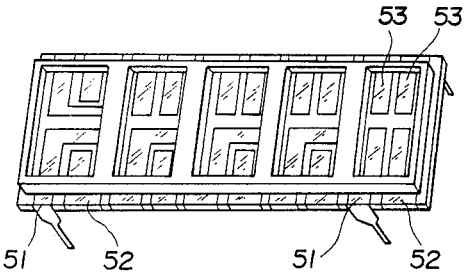
FIG. 10 is a perspective view of yet another switch according to the invention.

In the example described above, two juxtaposed rows of terminals on opposite sides of the base are shown in such a way, for the sake of simplicity, that one of them is a pair of ordinary terminals and that the other is a pair of terminals to which no external lead wires are connected. The device shown in FIG. 10 is similarly fabricated. In particular, this device includes a pair of ordinary terminals 51 disposed appropriately and another pair of terminals 52 to which upper internal lead wires 53 are connected. The two terminals on one side or the other may be connected together by the aforementioned contact element and excited.

Although in the previously described embodiments the contact element 37 is moved by the push member 48, a toggle or rotary means may also be used to move the contact element 37.

The base 31 and the cover 45 can be molded out of thermosetting resin, but the thermosetting temperature is high, e.g. 280° C. Further, the time required for such process is long. Therefore, it is cumbersome to control the manufacturing process using a thermosetting resin. However, when the base and the cover is made from thermoplastic resin, the temperature required for molding is relatively low, e.g., in the range of 170° to 260° C., and the time required is shorter. This facilitates the control of the manufacturing process and reduces the cost to manufacture the switch. In cases where a thermoplastic resin is employed, externally applied heat tends to soften the enclosure 31 and the cover 45, but the printed board 36 which is made of ceramic, glass, epoxy resin, or the like reinforces them and retains their mechanical and physical properties. Also, in the embodiment shown in FIGS. 1–5B, when the base 3 and the cover 4 are made from thermoplastic resin, if externally applied heat softens the resinous components, loss in their mechanical and physical properties and in strength can be compensated for by locating a reinforcing base plate (excluding an electric circuit) as described above in the position shown in FIGS. 7–9.

Figure 11:
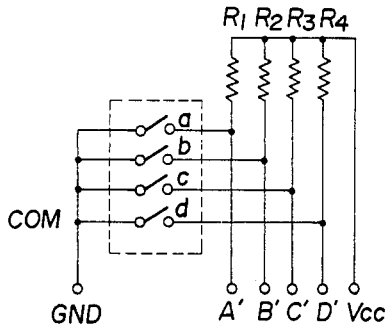
FIG. 11 is a diagram of the electronic circuit incorporated into a DIP switch according to the invention.

In this way, a DIP switch equipped with a certain number of slide switches can be fabricated. In an actual DIP switch, an electronic circuit is formed on the printed board 36 so as to cooperate with a potentiometer or chip selector through the use of switches. Such a chip selector is shown in FIG. 11, and it has switches a–d and output terminals A′–D′. When any of one of the switches a–d is closed, the voltage applied to the corresponding one of the terminals A′–D′ changes from $V_{cc}$ to ground potential GND. It is possible for this chip selector to deliver an output signal in binary form. Specifically, mathematical weights of $2^0$ to $2^3$ are given to the signals appearing at the switches a–d, respectively. Then, some of the terminals are closed simultaneously, resulting in data in parallel binary form at the output terminals A′–D′.

Figure 12:
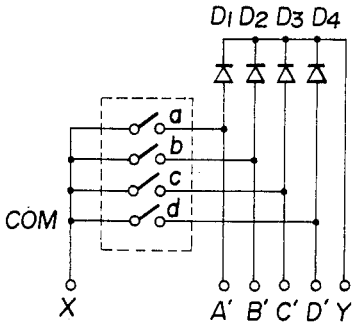
FIGS. 12, 13 and 14 are circuit diagrams of other electronic circuits in the form of chip selectors.

Although the devices used for the chip selector are all resistors in the above embodiment, these resistors can be replaced by capacitors, diodes or logical elements. Referring to FIG. 12, there is shown a chip selector constituting a four-input OR circuit. In this configuration, switches a–d are connected to diodes $D_1$–$D_4$, respectively, and one of the switches is closed.

Figure 13:
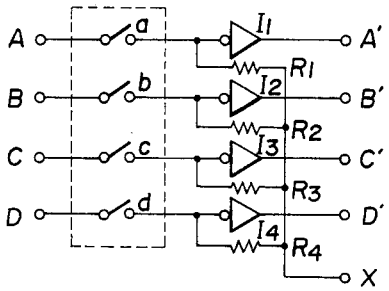

Referring next to FIG. 13, there is shown another chip selector which has an X terminal connected to a power supply $V_{cc}$, for grounded input terminals A–D, switches a–d, and logical elements $I_1$–$I_4$. When one of the switches a–d is closed, an inverted output signal appears at the corresponding one of the output terminals A′–D′ via the corresponding logical element.

Figure 14:
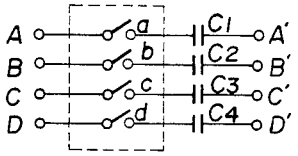

Referring next to FIG. 14, there is shown another chip selector which has input terminals A–D and output terminals A′–D′ which are connected to the input terminals through capacitors $C_1$–$C_4$ by closing switches a–d.

Figure 15:
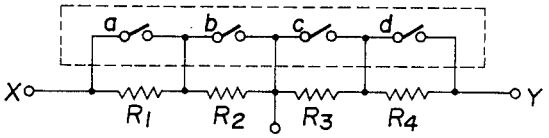
FIG. 15 is a circuit diagram of another electronic circuit in the form of a potentiometer.

A potentiometer is shown in FIG. 15, in which switches a–d are connected to resistors $R_1$–$R_4$, respectively, in parallel relation. A given resistance value is obtained across terminals X and Y by closing one of the switches a–d.

As can be understood from the foregoing embodiments, the present invention does not use a DIP switch independent of a printed board on which an electronic circuit is formed. Rather, the invention makes use of a DIP switch body and an electronic circuit which is made integral with the body by holding the printed board between the upwardly extending internal lead wires and downwardly extending internal lead wires, the lead wires being connected to their respective terminals, and by imbedding them in an insulating base. Further, the switching mechanism is simple. Additionally, since the active regions are exposed for making contact, the switch can effect a switching operation stably even with a minute electric current. Hence, a quite small-sized DIP switch incorporating an electronic circuit is provided.

Thus, there is provided in accordance with the invention a simplified electric switch structure which has the advantages discussed above. The embodiments described above are intended to be merely exemplary and those skilled in the art will be able to make variations and modifications in them without departing from the spirit and scope of the invention. All such modifications and variations are contemplated as falling within the scope of the invention delineated by the appended claims.

What is claimed is:

1. A simplified electric switch comprising:

an insulating base, a switch cover mounted on the base, said cover and said base defining a central space therebetween, opposing internal leads to which the terminals are bonded, the internal leads being mounted on the base, a rocking type movable contact element, mounted within said central space, in the form of an electrically conductive plate and having a curved belly portion, reversely bent shoulder portions at opposite sides of the belly portion, and pointed contact ends, each shaped into a pyramid, located at both ends of the contact element, the belly portion being centrally provided with a projection, the contact element being mounted with said projection sitting on said base so as to be able to rock on said base, and a push member having a protrusion engaging the curve of said belly portion from the side opposite said base, the push member further having an arm held for sliding movement between a shoulder portion and the lower surface of the switch cover, whereby movement of the push member toward one of said shoulder portions forces the protrusion to move along the belly portion and to flex said one shoulder portion toward said base thereby bringing the contact ends carried by said one shoulder portion into contact with the corresponding internal leads and exciting the terminals on one side of said base.

2. A simplified electric switch comprising:

an insulating base, a switch cover mounted on the base, said cover and said base defining a central space therebetween, opposing internal leads to which terminals are bonded, the internal leads being mounted on the base, a common internal lead mounted on said base between the opposing internal leads and connected to a common terminal, a rocking type movable contact element, mounted within said central space, in the form of an electrically conductive plate and having a curved belly portion, reversely bent shoulder portions at opposite sides of the belly portion, and pointed contact ends, each shaped into a pyramid, located at both ends of the contact element, the belly portion being centrally provided with a projection, the contact element being mounted with said projection sitting on said common terminal so as to be able to rock relative to said base, and a push member having a protrusion engaging the curve of said belly portion from the side opposite said base, the push member further having an arm held for sliding movement between a shoulder portion and the lower surface of the switch cover, whereby movement of the push member toward one of said shoulder portions forces the protrusion to move along the belly portion and to flex said one shoulder portion toward said base thereby bringing the contact ends carried by said one shoulder portion into contact with the corresponding internal leads and exciting the terminals on one side of said base.

3. A simplified electric switch comprising:

an insulating base, a switch cover mounted on the base, said cover and said base defining a central space therebetween, opposing terminals disposed on opposite sides of the base in a predetermined manner, and internal leads bonded to said terminals, a printed board having an electronic circuit formed on at least one side of said board and held between said internal leads, some of said internal leads extending along one surface of said board and being opposed to each other on the printed board, and the remainder of said internal leads extending along the opposite surface of said board, a rocking type movable contact element, mounted within said central space, in the form of an electrically conductive plate and having a curved belly portion, reversely bent shoulder portions at opposite ends of the belly portion, and pointed contact ends, each shaped into a pyramid, located at both ends of the contact element, the belly portion being centrally provided with a projection, the contact element being mounted with said projection sitting on said base so as to be able to rock on said base, and a push member having a protrusion engaging the curve of said belly portion from the side opposite said base, the push member further having an arm held for sliding movement between a shoulder portion and the lower surface of the switch cover, whereby movement of the push member toward one of said shoulder portions forces the protrusion to move along the belly portion and to flex said one shoulder portion toward said base thereby bringing the contact ends carried by said one shoulder portion into engagement with the corresponding internal leads.

* * * * *

UNITED STATES PATENT AND TRADEMARK OFFICE

CERTIFICATE OF CORRECTION

PATENT NO. : 4,525,607

DATED : June 25, 1985

INVENTOR(S) : Yasutaka SENOH

It is certified that error appears in the above—identified patent and that said Letters Patent is hereby corrected as shown below:

Column 1, line 24, a comma --,-- should be inserted after "switch".
Column 2, line 67, delete "for" and insert --view--.
Column 5, line 27, delete "on" and insert --an--.
Column 6, line 13, delete the word "of" which occurs after "any".
Column 6, line 32, after "for" insert --example,--.

Signed and Sealed this

*Twenty-ninth* Day of *October 1985*

[SEAL]

*Attest:*

*Attesting Officer*

DONALD J. QUIGG

*Commissioner of Patents and Trademarks—Designate*